US008033623B2

(12) United States Patent
Lee

(10) Patent No.: US 8,033,623 B2
(45) Date of Patent: Oct. 11, 2011

(54) REFRIGERATOR

(75) Inventor: Moon Seok Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 696 days.

(21) Appl. No.: 12/125,641

(22) Filed: May 22, 2008

(65) Prior Publication Data

US 2008/0290775 A1 Nov. 27, 2008

(30) Foreign Application Priority Data

May 23, 2007 (KR) ..... 10-2007-0050039

(51) Int. Cl.
*A47B 96/04* (2006.01)

(52) U.S. Cl. ..... 312/405; 312/329; 312/223.6

(58) Field of Classification Search ..... 312/405, 312/326, 329, 223.6; 16/2.1; 49/192, 193, 49/501, 382; 248/51; 211/26.2, 26; 174/153 G, 174/152 G, 152 R, 151, 135
See application file for complete search history.

(56) References Cited

U.S. PATENT DOCUMENTS

| | | | | |
|---|---|---|---|---|
| 4,715,512 | A * | 12/1987 | Buchser | 220/592.1 |
| 5,248,196 | A * | 9/1993 | Lynn et al. | 312/406 |
| 5,666,764 | A * | 9/1997 | Beatty et al. | 49/397 |
| 5,787,724 | A * | 8/1998 | Pohl et al. | 62/389 |
| 5,941,619 | A * | 8/1999 | Stieben et al. | 312/223.6 |
| 6,945,621 | B2 * | 9/2005 | Shin | 312/405 |
| 7,266,963 | B2 * | 9/2007 | Lee | 62/259.1 |
| 7,322,209 | B2 * | 1/2008 | Hwang et al. | 62/449 |
| 7,578,141 | B2 * | 8/2009 | Puthiyaveetil et al. | 62/389 |
| 2005/0138948 | A1 * | 6/2005 | Lee | 62/331 |
| 2005/0217308 | A1 * | 10/2005 | Hwang et al. | 62/440 |
| 2005/0284159 | A1 * | 12/2005 | Kim | 62/126 |
| 2008/0290775 | A1 * | 11/2008 | Lee | 312/405 |
| 2009/0289536 | A1 * | 11/2009 | Park et al. | 312/405 |
| 2010/0026155 | A1 * | 2/2010 | Yun | 312/405 |
| 2010/0033067 | A1 * | 2/2010 | Kim et al. | 312/236 |

* cited by examiner

*Primary Examiner* — Janet M Wilkens
*Assistant Examiner* — Daniel Rohrhoff
(74) *Attorney, Agent, or Firm* — Birch, Stewart, Kolasch & Birch, LLP

(57) ABSTRACT

A refrigerator includes a main body in which storage space is formed, a door pivotably mounted at a front of the main body, a hinge member connecting the main body with the door, and a receiving member which is mounted at an upper surface of the main body and accommodates a lead wire extended from at least one of the main body and door.

12 Claims, 3 Drawing Sheets

REFRIGERATOR

CROSS REFERENCES RELATED APPLICATIONS

The present application claims priority under 35 U.S.C. 119 and 35 U.S.C. 365 to Korean Patent Application No. 10-2007-0050039 (filed on May 23, 2007), which is hereby incorporated by reference in its entirety.

THE BACKGROUND

1. The Field

This document relates to a refrigerator.

2. Description of the Related Art

Generally, refrigerators are domestic appliances used to keep foods at a low temperature, and the refrigerators are capable of refrigerating or freezing foods depending on the type of the foods. And, cold air to be introduced into a chamber of the refrigerator is produced by heat exchange with refrigerant. That is, the temperature of air is lowered by heat exchange between the refrigerant and air through expansion of the air while the refrigerant repeats a cycle of compression-condensing-expansion-evaporation. And, low temperature air is supplied into the chamber of the refrigerator.

Meanwhile, according to a conventional refrigerator, a depression is formed at an upper surface of a main body, and a control box for controlling the operation of the refrigerator is seated on the depression. And, a lead wire, which is extended from electric components such as a display unit mounted on a refrigerator door, is connected to the control box via a hinge connecting the door with the main body.

Therefore, a plurality of lead wires are extended from the control box and are exposed out of the main body. In this case, in a process of foaming a heat insulating material into the main body, the lead wires have to be temporarily fixed on one side of the main body using a tape or other fixing means. And, after finishing the foaming process of the refrigerator door, the lead wires extended from the control box have to be connected with the electric components mounted on the door by removing the temporary fixing means.

In this way, according to the conventional refrigerator which is not provided with a separate means for processing the lead wires extended from the control box, there are disadvantages in that the number of processing steps is increased while suffering the decreases in productivity.

THE SUMMARY

The present invention is derived to resolve the above disadvantages.

To achieve the objects of the present invention, as embodied and broadly described herein, there is provided a refrigerator according to a preferred embodiment of the present invention, including a main body defining storage space; a door pivotably coupled to a front of the main body; a hinge member connecting the main body with the door; and a receiving member which is installed at an upper surface of the main body and accommodates a lead wire extended from at least one of the main body and the door.

In another aspect of the present invention, there is provided a refrigerator according to another preferred embodiment of the present invention, including a main body having an outer case forming an external appearance, an inner case provided in the outer case to form storage space, and an insulation member disposed between the outer case and the inner case; a control box depressed into an upper surface of the outer case and installed therein; and a receiving member, penetratingly coupled to the outer case, a lead wire extended from at least the control box being received.

THE DETAILED DESCRIPTION

Figure 1:
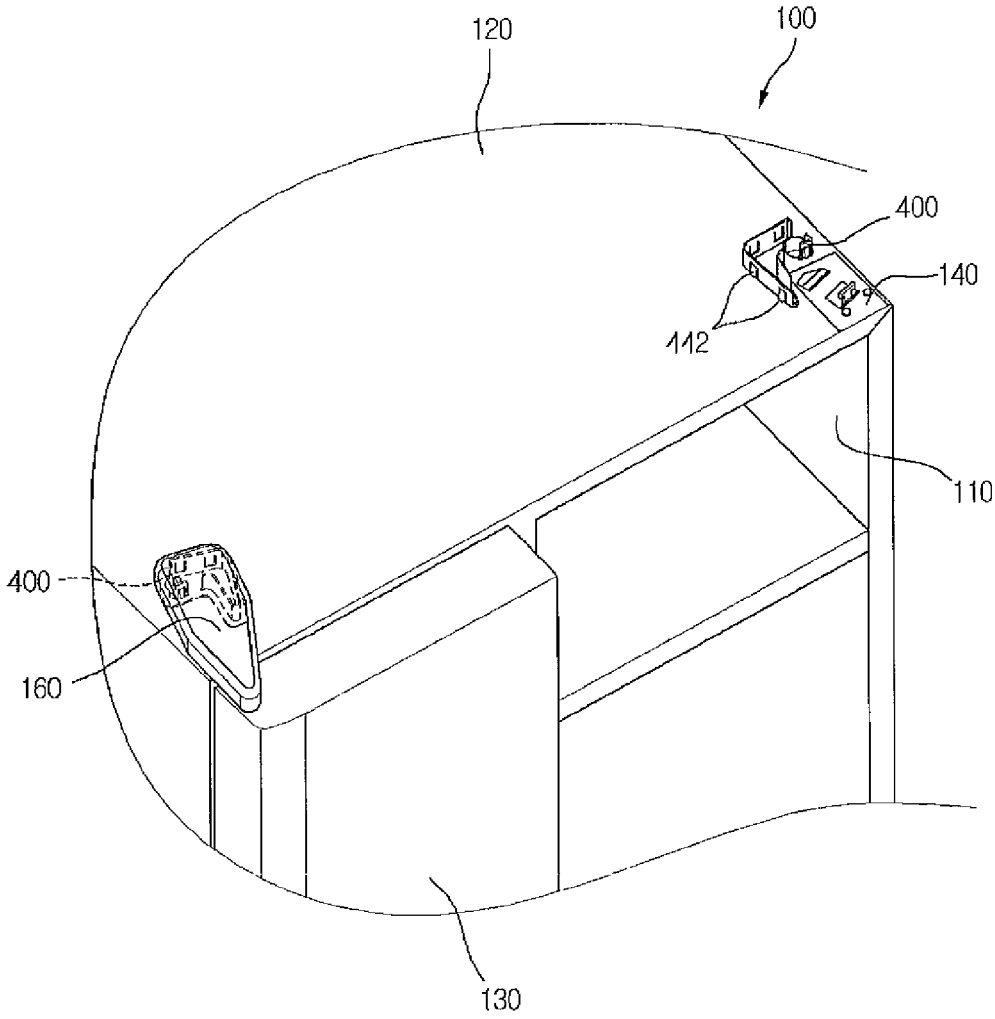
FIG. 1 is a partial perspective view of a refrigerator showing a lead wire fixing structure according to a preferred embodiment of the present invention.

FIG. 1 is a partial perspective view of a refrigerator showing a lead wire fixing structure according to a preferred embodiment of the present invention.

Referring to FIG. 1, the refrigerator 100 according to the preferred embodiment of the present invention includes an inner case 110 forming an inner part of a main body, an outer case 120 connected to an outer part of the inner case 110 to form an external appearance of the main body, and a door 130 pivotably mounted at a front surface of the main body.

In detail, a heat insulating material is foamed between the inner case 110 and the outer case 120. Further, the door 130 is connected to one side edge of the main body via a hinge 140, and the hinge 140 is covered by a hinge cover 160. And, a receiving member 400 in which a lead wire is received is installed at an upper surface edge of the main body. More specifically, a hole having the same shape as the receiving member 400 is formed in the upper surface of the main body at a location where the receiving member 400 is installed. And, the receiving member 400 is connected by perforating the hole in a direction from an inner side to an outer side of the outer case 120. And, the receiving member 400 is not exposed to the outside, since it is also covered by the hinge cover 160. And, an open, upper surface of the receiving member 400 is closed by the hinge cover 160.

Figure 2:
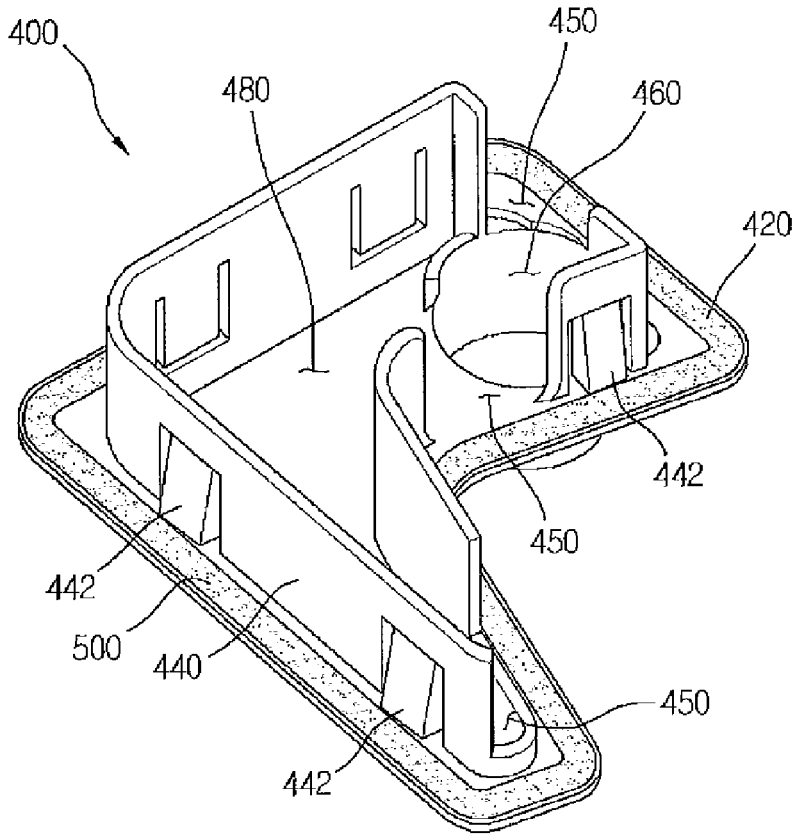
FIG. 2 is an external appearance perspective view of a receiving member according to a preferred embodiment of the present invention.
Figure 3:
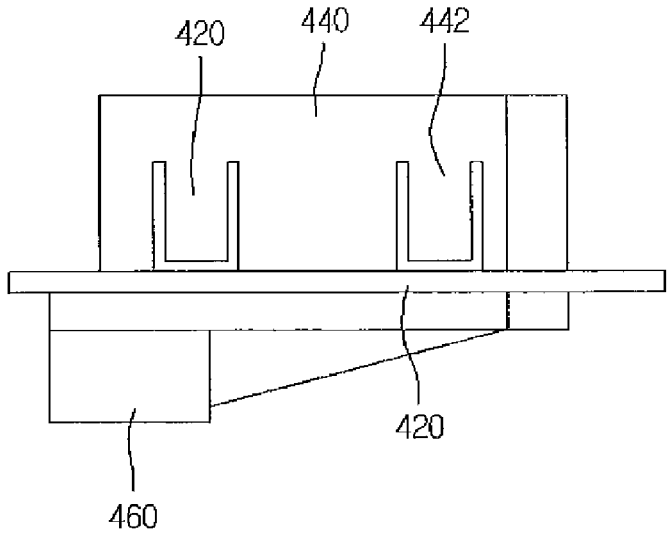
FIG. 3 is a side view of the receiving member.

FIG. 2 shows a receiving member according to the preferred embodiment of the present invention in an external appearance perspective view, and FIG. 3 shows the receiving member in a side view.

Referring to FIGS. 2 and 3, the receiving member 400 according to the preferred embodiment of the present invention includes a base 420, an enclosing wall 440 extended from an upper surface of the base 420 to enclose the base 420, a main body-side introducing port 460 formed in the base 420 at a predetermined size, and a sealing part 500 enclosing a contour of the upper surface of the base 420 with a predetermined width. And, a receiving part 480 in which a bundle of lead wires are received is formed in the enclosing wall 440, and an open, upper surface of the receiving part 480 is finally covered by the hinge cover 160.

Meanwhile, some of the enclosing wall 440 is cut off at a predetermined distance to form a lead wire introducing port. Specifically, the lead wire introducing port is composed of a main body-side introducing port 460 and a door-side introducing port 450. More specifically, the main body-side introducing port 460 is a passage through which lead wires extended from the control box seated on the upper surface of the main body are introduced into the receiving part 480, and the door-side introducing port 450 is a passage through which lead wires extended from the electric components such as a display unit mounted in the door. And, the main body-side introducing port 460 is extended from the base 420 to a lower side at a predetermined length, and it may be a hollow cylinder. That is, it may be a circular or polygon cylinder having a predetermined length. And, the lead wire extended from the control box is extended through a space between the outer case 120 and the inner case 110 and is drawn through the main body-side introducing port 460. And, the lead wire drawn out of the main body is received in the receiving part 480.

Also, a plurality of elastic ribs 442 are formed at the enclosing wall 440. Specifically, the elastic ribs 442 are downwardly inclined at a predetermined angle and are inclined out of the enclosing wall 440 in the direction of the outside. And, a lower end of the elastic ribs 442 are spaced apart from the upper surface of the base 420. And, the spaced distance is the same as the thickness of the outer case 120 of the main body. And, an edge portion of a hole formed at the outer case 120, in which the receiving member 400 is fitted, is inserted into the discrete space.

Figure 4:
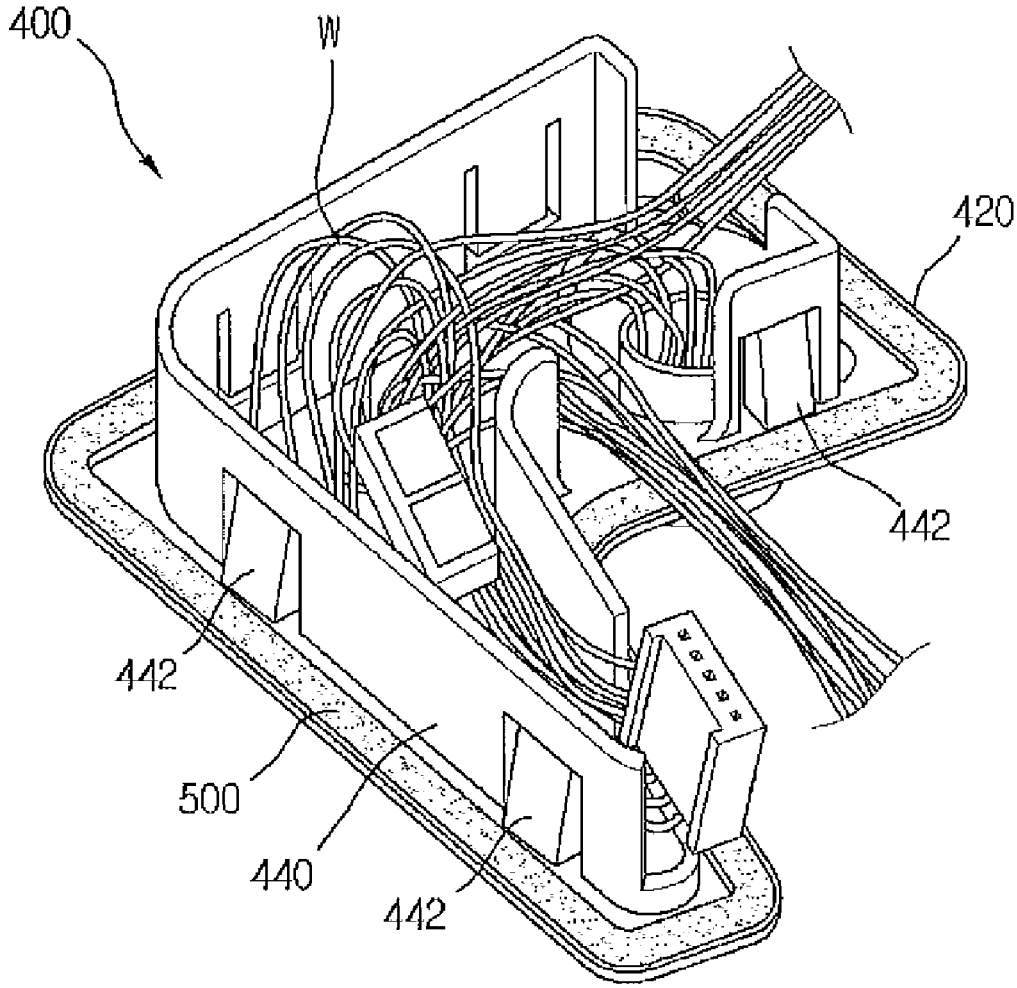
FIG. 4 is a perspective view showing a state where a lead wire is received in the receiving member according to a preferred embodiment of the present invention.

FIG. 4 shows a state where a lead wire is received in the receiving member according to the preferred embodiment of the present invention in a perspective view.

Referring to FIG. 4, a bundle of the lead wires W are received in the receiving part 480 formed at an inside of the enclosing wall 440.

Before a bundle of the lead wires W are received in the receiving part 480, the receiving member 400 is needed to be installed at the main body, i.e. the outer case 120.

In detail, the receiving member 400 is disposed at a lower part of the outer case 120. Of course, the receiving member 400 is disposed right below a receiving hole formed in the outer case 120. And, the receiving member 400 is passed through the hole by pushing the receiving member 400 upward. In that case, a contour portion of the base 420 is tightly connected to a bottom surface of the outer case 120. In other words, the sealing part 500 is tightly connected to a bottom surface of the outer case 120. Accordingly, while an insulation member is foamed between the outer case 120 and the inner case 110 by the sealing part 500, the insulation member or moisture is prevented from leaking out of the outer case 120.

Also, when the receiving member 400 is fitted into the hole formed in the outer case 120, a contour portion of the hole is fitted into a space between the elastic rib 442 and the base 420. In other words, the elastic rib 442 is elastically deformed inward as it is interfered with the contour portion of the hole, however it is returned to its original location when the receiving member 400 is completely installed. In that case, a lower end of the elastic ribs 442 is contacted to an upper surface of the outer case 120. Therefore, the receiving member 400 is not detached from the hole, since it is fixedly fitted into the hole. Furthermore, if the sealing part 500 is made of a material having an adhesive property, the receiving member 400 will be fixed twice.

Meanwhile, in a state where the receiving member 400 is fixedly connected to the outer case 120, the inner case 110 is fitted into the outer case 120 while being inwardly spaced apart from the outer case. And, the insulation member is foamed into a space between the outer case 120 and the inner case 110. Here, the lead wire extended from the control box is drawn out of the outer case 120 through the main body-side introducing port 460, before accomplishing an insulation member foaming process. Of course, the lead wire extended from the door may be connected with the control box by extending the lead wire through a gap between the inner case 110 and the outer case 120 via the main body-side introducing port 460.

After the foaming process is finished and the door is installed at the main body, if the receiving member 400 is covered by the hinge cover 160, the lead wire is not exposed to the outside and is concisely arranged.

According to the above receiving member 400, there are advantages in that the foaming process which foams the insulation member into a space between the inner case 110 and the outer case 120 is not prohibited by the lead wire, and in that the lead wire is concisely arranged. Also, the lead wires are prevented from being damaged by extrinsic factors while a bundle of the lead wires are not exposed out of the refrigerator.

What is claimed is:

1. A refrigerator, comprising:

a main body having an outer case forming an external appearance, an inner case provided in the outer case to form a storage space, and an insulation member disposed between the outer case and the inner case;

a door pivotably coupled to a front of the main body;

a hinge member connecting the main body with the door;

a receiving member which is installed at an upper surface of the outer case and accommodates a lead wire extended from the main body and the door and guides the lead wire; wherein the receiving member comprises: a base defining a bottom surface; an enclosing wall extended from an upper surface of the base to guide the lead wire; and a plurality of elastic ribs formed at the enclosing wall so that the receiving member is fixed to the outer case and a cover formed to cover the hinge member and the receiving member, wherein the receiving member and the lead wire are not exposed to the outside when covered by the cover and the lead wire is concisely arranged inside of the receiving member.

2. The refrigerator according to claim 1, wherein the receiving member penetrates the outer case in a direction from lower to higher to be inserted thereinto.

3. The refrigerator according to claim 1, wherein the enclosing wall follows the contour of the base but is inwardly spaced from an edge of the base.

4. The refrigerator according to claim 1, further comprising:

a sealing part which surrounds a contour portion of the base and is in close contact with a bottom surface of the outer case.

5. The refrigerator according to claim 4, wherein the sealing part is an adhesive member.

6. The refrigerator according to claim 1, further comprising a door-side introducing port which is formed as some of the enclosing wall is cut off.

7. The refrigerator according to claim 1, further comprising a main-body introducing port which is formed in the base to pass a lead wire.

8. The refrigerator according to claim 7, wherein the main body introducing port is formed in the shape of a cylinder.

9. The refrigerator according to claim 7, wherein the main body-side introducing port extends from the base to introduce the lead wire between the outer case and the inner case.

10. The refrigerator according to claim 1, wherein a lower end of the elastic rib is spaced apart from the base, and an upper surface of the outer case is fitted into the spaced space.

11. The refrigerator according to claim 1, wherein when the receiving member is inserted into the outer case, the elastic rib is returned to its original location after being elastically deformed.

12. The refrigerator according to claim 1, wherein an enclosing wall is formed in a bent shape so that a bundle of the lead wires are concisely extended in a certain direction.

* * * * *